US006102391A

United States Patent [19]

Malick et al.

[11] Patent Number: 6,102,391

[45] Date of Patent: Aug. 15, 2000

[54] RIGHT ANGLE TRANSFER APPARATUS

[75] Inventors: Shahzad Malick, Fairfield; Neil J. Kennedy, Woodbury; Linda A. Howard, Brookfield, all of Conn.; Douglas Sprenger, Dover Plains, N.Y.; Charles C. Fuller, Shelton, Conn.

[73] Assignee: Pitney Bowes Inc., Stamford, Conn.

[21] Appl. No.: 09/079,916

[22] Filed: May 15, 1998

[51] Int. Cl.[7] ..... B65H 5/00

[52] U.S. Cl. ..... 271/225; 271/184; 53/284.3

[58] Field of Search ..... 53/284.3, 381.5, 53/381.6, 381.7, 569; 271/225, 184

[56] References Cited

U.S. PATENT DOCUMENTS

| | | | |
|---|---|---|---|
| 4,724,945 | 2/1988 | Martin | 198/412 |
| 4,909,374 | 3/1990 | Skrypalle | 198/371 |
| 4,955,185 | 9/1990 | Haas et al. | 53/569 |
| 5,088,721 | 2/1992 | Suzuki et al. | 271/184 |
| 5,180,154 | 1/1993 | Malick | 271/2 |
| 5,180,159 | 1/1993 | Malick | 271/302 |
| 5,188,355 | 2/1993 | Lowell et al. | 271/225 |
| 5,538,239 | 7/1996 | Auerbach et al. | 271/225 |
| 5,653,438 | 8/1997 | Crowley et al. | 271/225 |
| 5,667,214 | 9/1997 | Belec et al. | 271/225 |

*Primary Examiner*—Peter Vo
*Assistant Examiner*—Louis L. Huynh
*Attorney, Agent, or Firm*—Christopher J. Capelli; Michael E. Melton

[57] ABSTRACT

An apparatus for changing the direction of travel of a flat article being conveyed seriatim along a paper path without changing the orientation of the flat article with respect to a first direction of travel. The apparatus includes a deck having an upstream end for receiving a flat article being conveyed along a paper path in a first direction and a registration wall upstanding on the deck and spaced from the upstream end, the registration wall having a longitudinal axis defining a second direction that is substantially orthogonal to the first direction. A drive assembly is operatively coupled to the deck in proximity to the registration wall and is operative to seize a first leading edge of a flat article traveling in the first direction on the deck and convey the flat article in the second direction such that the leading edge of the flat article abuts against the registration wall.

5 Claims, 5 Drawing Sheets

RIGHT ANGLE TRANSFER APPARATUS

FIELD OF THE INVENTION

The present invention relates generally to apparatus for changing the direction of motion of documents, and more particularly, for changing the direction of motion of documents without turning the documents.

BACKGROUND OF THE INVENTION

Multi-station document inserting systems generally include a plurality of various stations that are configured for specific applications. Typically, such inserting systems, also known as console inserting machines, are manufactured to perform operations customized for a particular customer. Such machines are known in the art and are generally used by organizations, which produce a large volume of mailings where the content of each mail piece may vary.

For instance, inserter systems are used by organizations such as banks, insurance companies and utility companies for producing a large volume of specific mailings where the contents of each mail item are directed to a particular addressee. Additionally, other organizations, such as direct mailers, use inserts for producing a large volume of generic mailings where the contents of each mail item are substantially identical for each addressee. Examples of such inserter systems are the 8 series and 9 series inserter systems available from Pitney Bowes, Inc. of Stamford, Conn.

In many respects the typical inserter system resembles a manufacturing assembly line. Sheets and other raw materials (other sheets, enclosures, and envelopes) enter the inserter system as inputs. Then, a plurality of different modules or workstations in the inserter system work cooperatively to process the sheets until a finished mailpiece is produced The exact configuration of each inserter system depends upon the needs of each particular customer or installation.

For example, a typical inserter system includes a plurality of serially arranged stations including an envelope feeder, a plurality of insert feeder stations and a burster-folder station. There is a computer generated form or web feeder that feeds continuous form control documents having control coded marks printed thereon to a cutter or burster station for individually separating documents from the web. A control scanner is typically located in the cutting or bursting station for sensing the control marks on the control documents. According to the control marks, these individual documents are accumulated in an accumulating station and then folded in a folding station. Thereafter, the serially arranged insert feeder stations sequentially feed the necessary documents onto a transport deck at each insert station as the control document arrives at the respective station to form a precisely collated stack of documents which is transported to the envelope feeder-insert station where the stack is inserted into the envelope. A typical modern inserter system also includes a control system to synchronize the operation of the overall inserter system to ensure that the collations are properly assembled.

Typically, such inserter systems include a modular component that changes a documents direction of motion by 90°. Such devices are commonly known as a right-angle turner module and are advantageous in that it changes the configuration of an inserter system (e.g., the inserter "footprint") so as to accommodate a users environment.

Essentially, these right-angle turner modules turn flat articles such as letter envelopes, within a plane. Such devices have been used in inserting machines when envelopes are discharged from an insert station at which the envelope is stuffed with enclosures and the envelopes must be turned and reoriented before being conveyed for further processing by a downstream device such as an envelope sealer. Generally, such devices have the disadvantage of having to be an integral part of the inserting machine. Examples of devices which turn flat articles in inserting machines are shown in commonly assigned U.S. Pat. No. : 4,726,461 to J. Pokrinchak and U.S. Pat. No. 4,928,807 to D. Auerbach.

It is known to change the direction of travel for flat articles without changing the orientation of the articles, i.e., without rotating or turning the articles, referred to herein as a "right angle transfer". One example of a right angle transfer is a device that provides a one stage right angle change in direction in which the articles must be stopped in one direction before being conveyed in the right angled direction. Such a device is described in commonly assigned U.S. Pat. No. 4,909,374 to M. Skrypalle.

Other right angle transfers are known to include two or more stages one of which includes deflection rollers that change the direction of travel by forty-five degrees (45°) or less at each stage. An example of such an apparatus in a sorting machine is disclosed in U.S. Pat. No. 4,527,792 issued Jul. 9, 1985 to G. Burkhardt. The Burkhardt apparatus has several limitations which prevent it from being usable in an inserting machine. The apparatus is limited to changing direction of travel from a path parallel to a long edge of the mailpiece to a path of travel parallel to the short edge thereof Furthermore, for all sized mailpieces, the Burkhardt apparatus requires a side-justified line of travel along the first direction of travel so that the deflection rollers can engage the article at the right moment to achieve an accurate change in direction. Typically, in an inserting machine the center line of travel of the mailpiece is fixed with the side guides being adjustable for handling various sized mailpieces.

Several versions of right angle transfers are known for use in inserting machines. In commonly assigned U.S. Pat. No. 5,180,154 to S. Malick, a right angle transfer apparatus for conveying flat articles in an inserting machine is disclosed. The apparatus includes a deck having an input end for receiving an article from a first direction and a plurality of angled roller pairs for conveying the article over the deck in the second direction. The angled roller pairs engage a leading edge of the article only after the article has been released by a conveying means in the first direction. A registration wall, which extends at a right angle to the first direction, is positioned downstream from the angled roller pairs adjacent an output end of the deck. The leading edge of the article is driven against the registration wall as the article is released by the angled roller pairs. A third direction conveying means takes control of the article as soon as the article is against said registration wall.

Variations of the Malick'154 right angle transfer apparatus are also known. Commonly assigned U.S. Pat. No. 5,180,159 to S. Malick provides an adjustable right angle transfer apparatus for conveying flat articles in one of two directions. This apparatus is similar to the Malick'154 apparatus but the angled roller pairs for conveying in a second direction are mounted on a circular deck that can be rotated to position the rollers for conveying forty-five degrees to the left or to the right. Commonly assigned U.S. Pat. No. 5,188,355 to K. Lowell et al. provides a right angle transfer apparatus for sheets of paper. This apparatus is also similar to Malick'154 except for changes found to be necessary in moving individual sheets through the right angle transfer at high speed. For example, the registration wall was eliminated and spring guides were added to prevent the sheets from lifting off the deck.

The foregoing apparatus are configured for handling documents of a particular size, such as envelopes or sheets of paper. Although the foregoing apparatus work well for handling single size documents, they lack adjustment capability needed for handling multiple size documents. Typically, the foregoing apparatus requires the addition or removal of rollers angled at forty five degrees (45°) when the apparatus is used to handle larger or smaller documents respectively. Furthermore, the foregoing require a large amount of floor space due to its large footprint resulting from the intermediate forty five (45°) travel path provided on its deck.

SUMMARY OF THE INVENTION

The present invention provides an apparatus for changing the direction of travel of a flat article being conveyed seriatim along a paper path without changing the orientation of the flat article with respect to a first direction of travel. The present invention transfer apparatus provides adjustable features for handling different sized flat article and has a smaller footprint relative to the aforementioned prior art.

A preferred embodiment of the apparatus includes a frame defining a first deck portion having an upstream end for receiving a flat article being conveyed along a paper path in a first direction along a first longitudinal axis. A deck assembly is slidably mounted in the frame and defines a second deck portion that is substantially coplanar with the first deck portion. The second deck portion has a downstream end that is slidable along the first longitudinal axis such that the downstream end of the second deck portion is movable between a proximal and distal position relative to the upstream end of the first deck portion.

The transfers apparatus further includes a registration wall upstanding along the downstream end of the second deck portion, which registration wall defines a second paper path direction of travel along a second longitudinal axis that is substantially orthogonal to the first longitudinal axis of the first deck portion. A drive assembly is operatively coupled to the second deck portion in proximity to the registration wall and is operative to seize a first leading edge of a flat article traveling in the first direction on the first deck portion and convey the flat article in the second paper path direction such that the leading edge of the flat article abuts against the registration wall.

The drive assembly preferably includes a plurality of roller pairs operative to seize the first leading edge of a flat article traveling in the first direction and convey the flat article in the second direction such that the leading edge of the flat article abuts against the registration wall. Each roller pair has a nip defining a travel axis that is oriented at an acute angle relative to the first direction such that each roller pair imparts both a vertical and horizontal velocity vector onto a flat article relative to the second longitudinal axis of the registration wall whereby the vertical velocity vector abuts the leading edge of the flat article against the registration wall in a direction orthogonal to the longitudinal axis of the registration wall and the horizontal velocity vector conveys the flat article in the second direction along the longitudinal axis of the registration wall.

BRIEF DESCRIPTION OF THE DRAWINGS

The above and other objects and advantages of the present invention will become more readily apparent upon consideration of the following detailed description, taken in conjunction with accompanying drawings, in which like reference characters refer to like parts throughout the drawings and in which.

DETAILED DESCRIPTION OF THE PREFERRED EMBODIMENT

Figure 1:
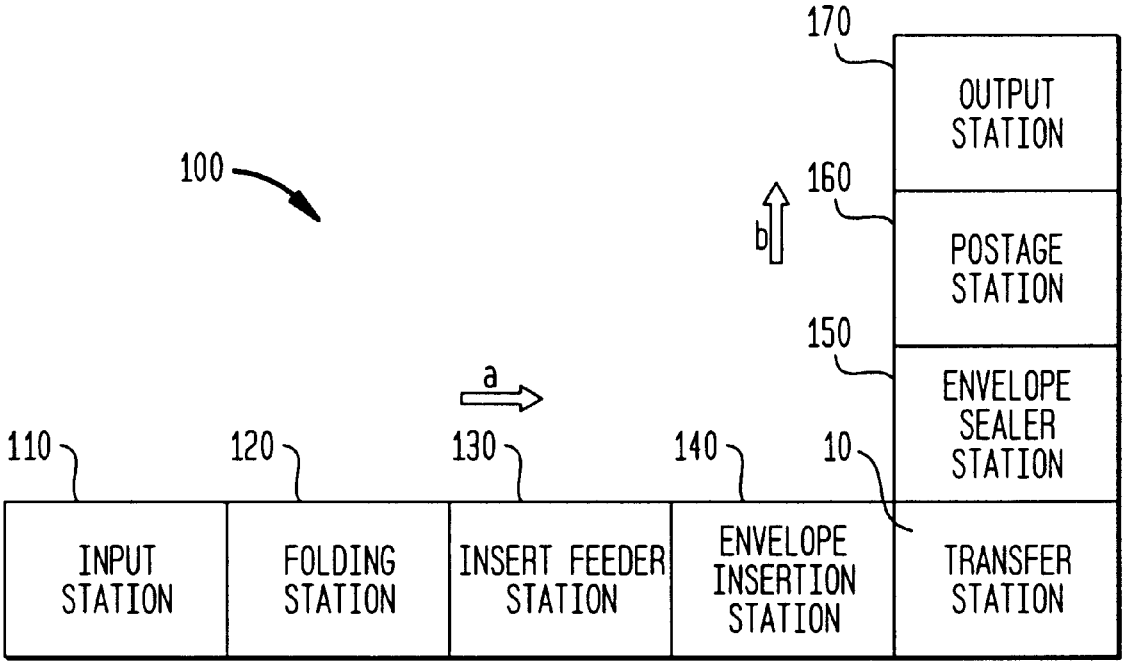
FIG. 1 is a block diagram of a document inserting system in which the present invention transfer module is incorporated.

In describing the preferred embodiment of the present invention, reference is made to the drawings, wherein there is seen in FIG. 1 a schematic of a typical document inserting system, generally designated 100, which implements the present invention transfer module 10. In the following description, numerous paper handling stations implemented in inserter system 100 are set forth to provide a thorough understanding of the operating environment of the present invention. However, it will become apparent to one skilled in the art that the present invention may be practiced without the specific details in regards to each of these paper-handling stations.

As will be described in greater detail below, system 100 preferably includes an input station 110 that feeds paper sheets from a paper web to an accumulating station that accumulates the sheets of paper in collation packets. Preferably, only a single sheet of a collation is coded (the control document), which coded information enables the control system of inserter system 100 to control the processing of documents in the various stations of the mass mailing inserter system. The code can comprise a bar code, UPC code or the like.

Essentially, input station 110 feeds sheets in a paper path, as indicated by arrow "a," along what is commonly termed the "deck" of inserter system 100. After sheets are accumulated into collations by input station 110, the collations are folded in folding station 120 and the folded collations are then conveyed to a insert feeder station 130. It is to be appreciated that a typical inserter system 100 includes a plurality of feeder stations, but for clarity of illustration only a single insert feeder 130 is shown.

Insert feeder station 130 is operational to convey an insert (e.g., an advertisement) from a supply tray to the main deck of inserter system 100 so as to be nested with the aforesaid sheet collation conveying along the main deck. The sheet collation, along with the nested insert(s) are next conveyed into an envelope insertion station 140 that is operative to insert the collation into an open envelope. The envelope is then preferably conveyed to the present invention transfer module station 10.

As will be explained in greater detail below, the transfer module 10 changes the direction of motion of flat articles (e.g., envelopes) from a first path (as indicated by arrow "a") to a second path (as indicated by arrow "b"). In other words, transfer module 10 takes a stuffed envelope from the envelope insertion station 140 and changes its direction of travel by ninety degrees (90°). Hence, transfer module 10 is commonly referred to in the art as a "right-angle transfer module".

After the envelope changes its travel direction in transfer module 10 the envelope is then preferably conveyed to an envelope sealer station 150 for the sealing of the envelope. The envelope may then be conveyed into a postage station 160 for the affixation of appropriate postage. Finally, the envelope is preferably conveyed to an output station 170 that collects the envelopes for postal distribution.

As previously mentioned, inserter system 100 includes a control system coupled (not shown) to each modular station of inserter system 100, which control system controls and harmonizes operation of the various modular stations implemented in inserter system 100. Preferably, control system uses an Optical Character Reader (OCR) for reading the code from each coded document. Such a control system is well known in the art and since it forms no part of the present invention, it is not described in detail in order not to obscure the present invention. Similarly, since none of the other above-mentioned modular components (namely: input station 110, folding station 120, insert feeder station 130, envelope insertion station 140, envelope sealer station 150, postage station 160 and output station 170) form no part of the present invention transfer module 10, further discussion of each of these stations is also not described in detail in order not to obscure the present invention.

Moreover, it is to be appreciated that the depicted embodiment of inserter system 100 implementing the present invention transfer module 10 is only to be understood as an exemplary configuration of such an inserter system 100. It is of course to be understood that such an inserter system may have many other configurations in accordance with a user's specific needs.

Figure 2:
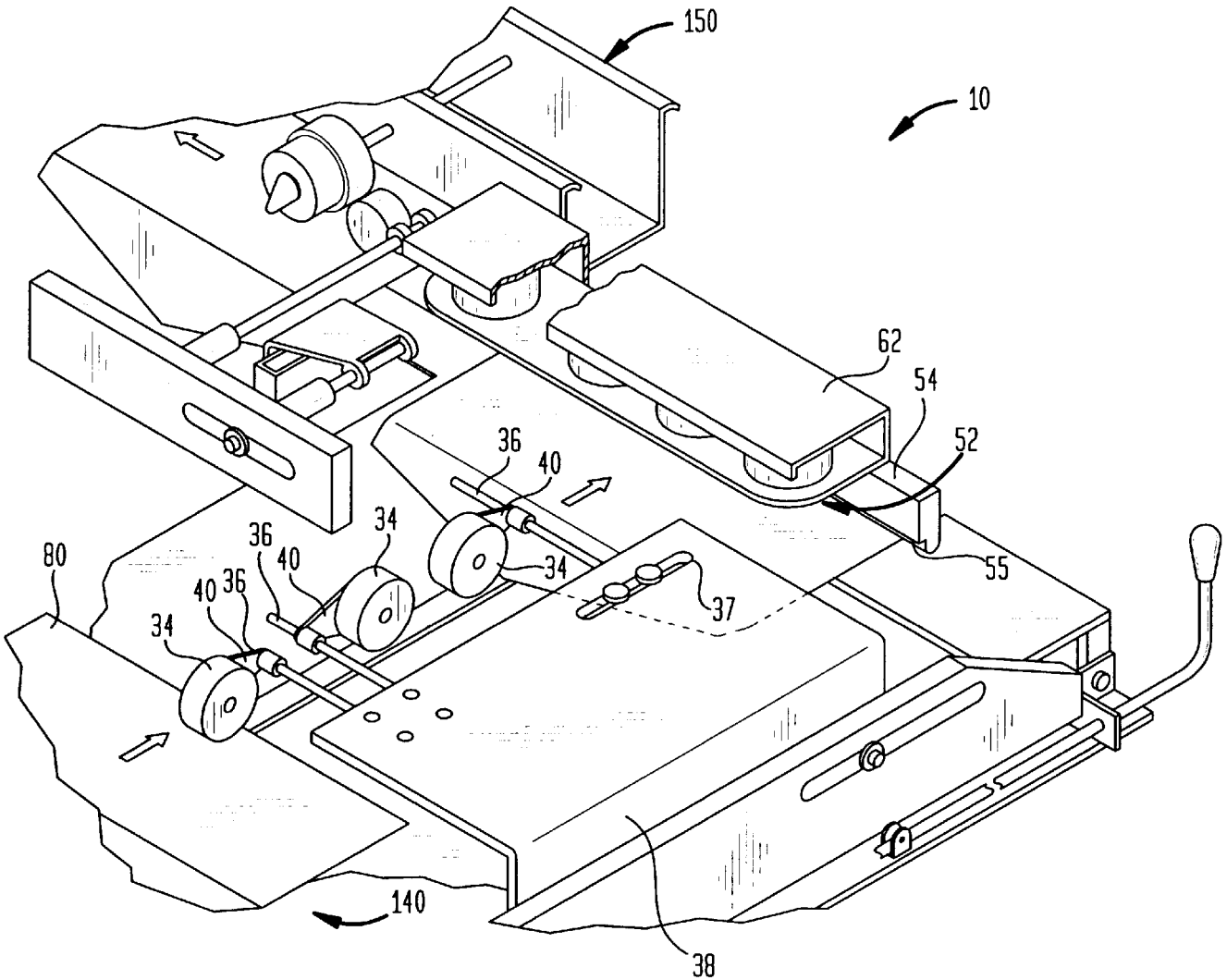
FIG. 2 is a perspective view of the right-angle transfer module implemented in the inserting system of FIG. 1.
Figure 3:
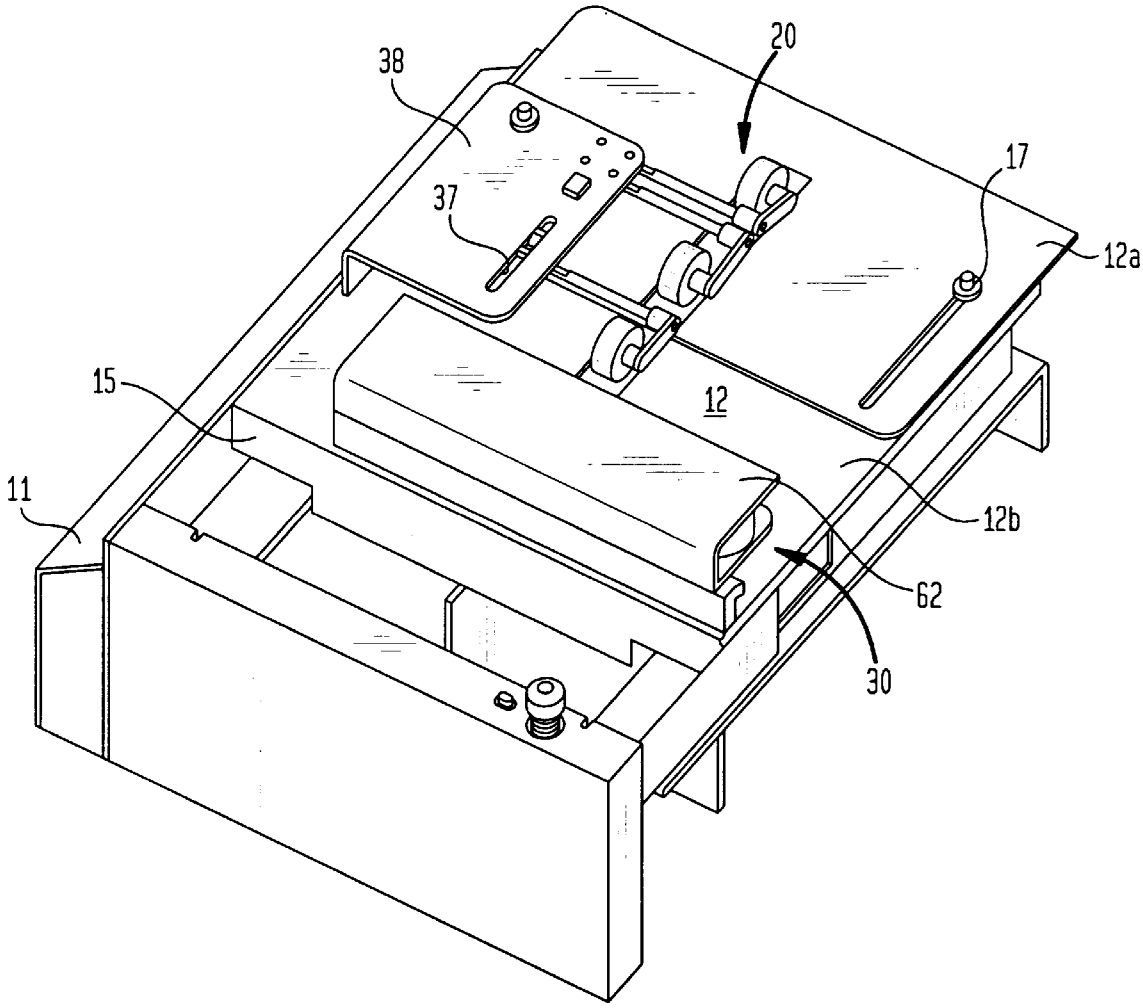
FIG. 3 is a perspective view of the right-angle transfer module of FIG. 2 separated from the inserting system of FIG. 1.
Figure 4:
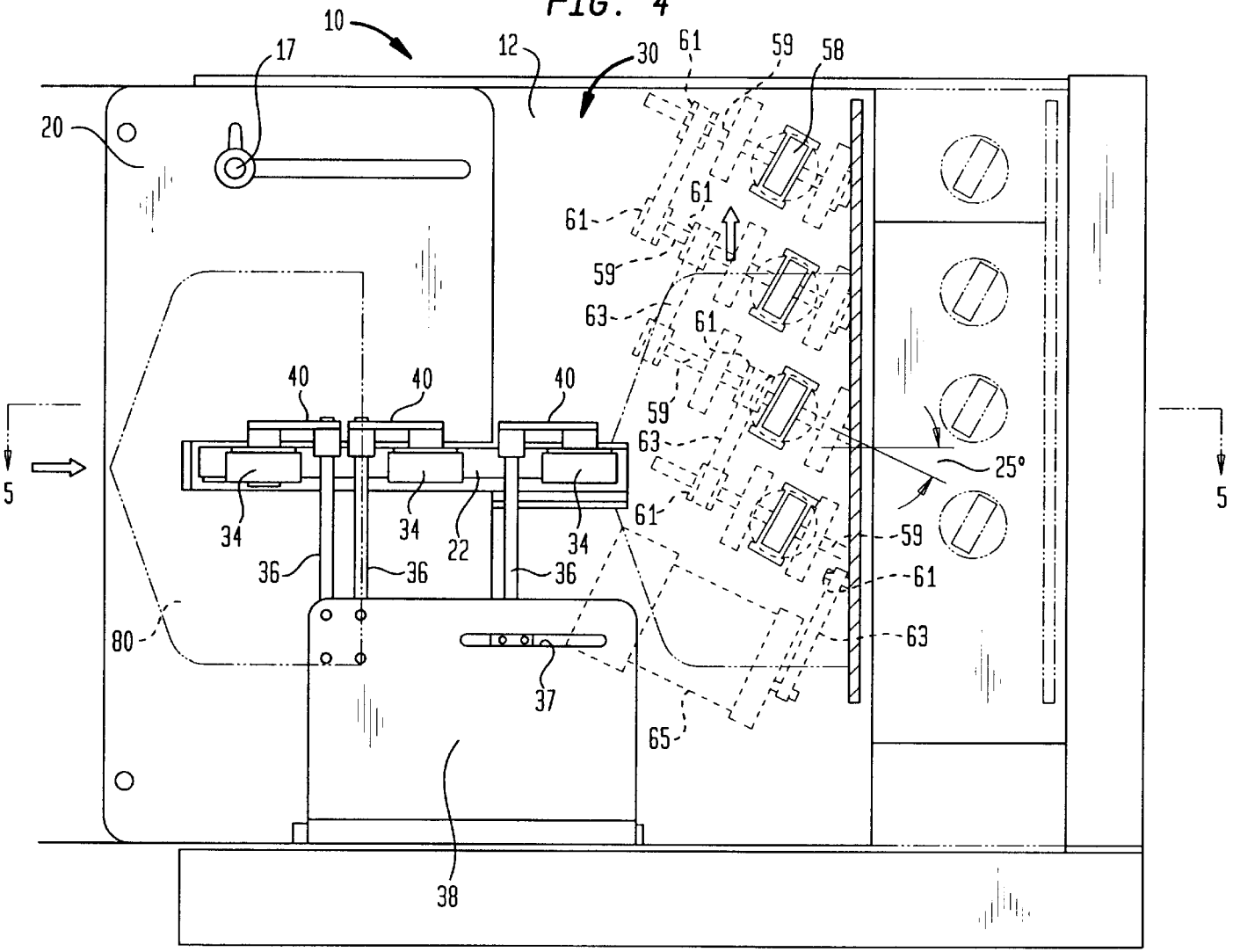
FIG. 4 is a top plan view of the right-angle transfer module of FIG. 3.

Referring now to FIGS. 2–4, the preferred embodiment transfer module is shown, generally designated 10. The transfer module 10 includes a frame member 11 and a deck assembly 15 defining a deck plate 12*b*. As will be discussed in greater detail below, the deck assembly 15 is slidable mounted in the frame 11. The transfer module 10 is defined by an input section, generally designated 20 and an output transfer section, generally designated 30. In accordance with the preferred embodiment, transfer module 10 transports individual documents (e.g., envelopes) having a landscape orientation at the input section 20 and outputs the document at the output transfer section 50 with the document in a portrait orientation (see FIG. 7). (It will be understood that transfer module 10 could also transport documents from portrait to landscape).

The input section 20 includes an endless, flat transport belt 22 which has an upper reach that extends through a slot formed in the deck 12. As best seen in FIG. 3, the deck 12 of transfer module 10 consists of first and second deck plates 12*a* and 12*b* wherein the first deck plate 12*a* is fixed relative to the frame 11 and the second deck plate 12*b* is fixed to the deck assembly 15 which is slidable relative to the frame 11. A set screw 17 is affixed to an end of the second deck plate 12*b* and extends through a slot formed in the first deck plate 12*a*. The set screw 17 has a conventional locking assembly and is used to maintain the second deck plate 12*b* at a prescribed position relative to the first deck plate 12*a*.

Figure 5:
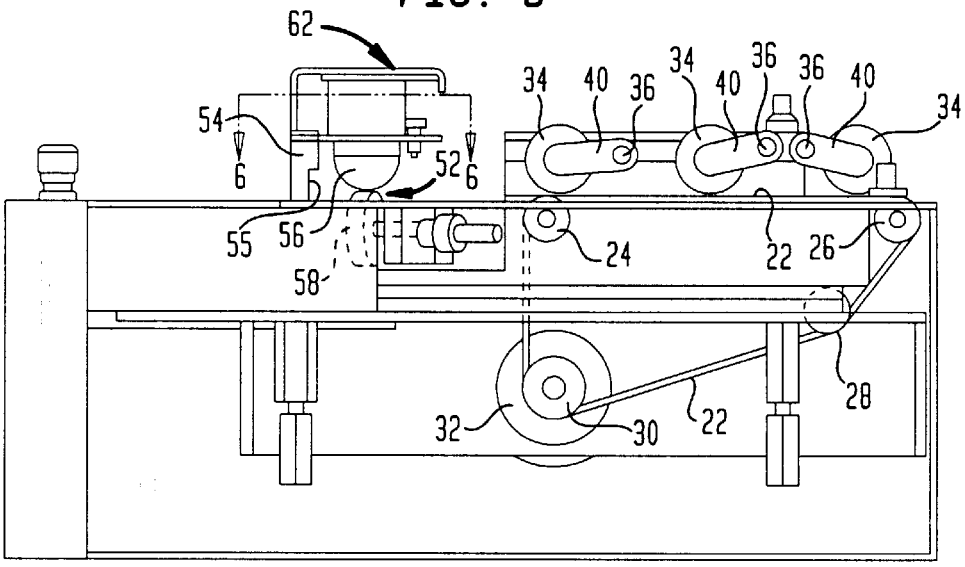
FIG. 5 is an end view of the right-angle transfer module of FIG. 4 taken along lines 5—5.

As best seen in FIG. 5, the transport belt 22 travels around four pulleys 24, 26, 28 and 30, one of which (pulley 30) is driven by a motor 32. A normal force is applied to the transport belt 22 by a series of biased, idler rollers 34. Each idler roller 34 includes a supporting shaft 36 extending from a first mounting plate 38. The distal most supporting shaft 36 relative to the first deck plate 12*a* has an end slidably mounted within a slot 37 formed in the first mounting plate 38 so as to be adjustable relative to the deck 12 of the transfer module 10. Each idler roller 34 is rotatably mounted on a pivotal lever arm 40. A torsion spring is mounted on each shaft 36 and is attached at one end to shaft 36 and at the other end to lever arm 40 so as to bias each idler roller 34 downward against the transport belt 22 thereby providing the normal force against the transport belt 22. In this manner, the transfer module 10 can handle envelopes of various thickness.

The output transfer section 30 includes a plurality of roller pairs, generally designated 52. Each roller pair 52 is spaced a fixed distance from a registration wall 54. The registration wall 54 extends from, and is fixably connected to the second deck plate 12*b* of the deck assembly 15 of the transfer module 10. As will be appreciated below, the registration wall 54 functions as a backstop against which envelopes will abut against and then be guided by its planar guide surface 55 so as to change its travel direction by ninety degrees (90°) relative to its first travel direction in the input section 20 (as defined by the longitudinal axis of the transport belt 22, as indicated by arrow "X" in FIG.7).

Figure 6:
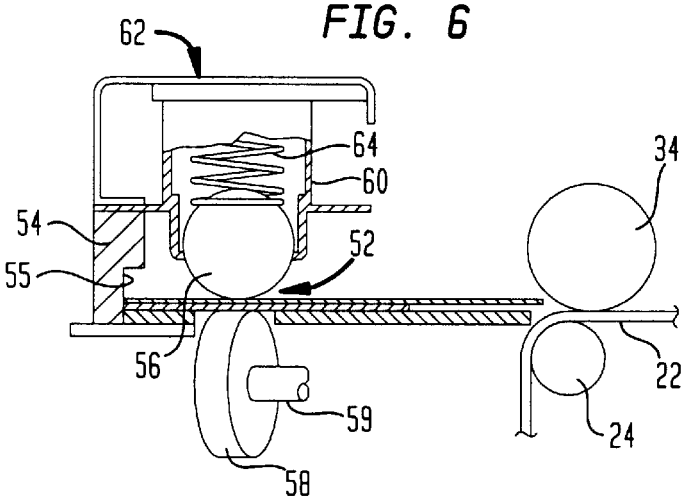
FIG. 6 is a partial cross-sectional view of the transfer section of the right-angle transfer module of FIG. 5 taken along lines 6—6.

As best seen in FIG. 6, each roller pair includes an upper, biased idler roller 56 and corresponding lower driven roller 58. In the preferred embodiment, the lower driven rollers 58 are angled at twenty-five degrees (25°) relative to the aforesaid longitudinal axis of the transport belt 22, the significance of which will be explained below. Thus, the velocity component vector perpendicular to the registration wall 54 is 0.422 (sine25°) and the velocity component vector horizontal to the registration wall 54 is 0.906 (cosine25°) .Therefore, the resulting parallel velocity vector from each roller pair 52 is more than twice as large than that of its resulting vertical velocity vector. It has been found that these velocity component vectors push an envelope against, and along, the planar surface 55 of registration wall 54, and the normal force affected upon the envelope by the idler rollers 56 creates an urge that prevents an envelope from bouncing away from the registration wall or buckling between the registration wall 54 and the nip formed between the idler roller 56 and driven roller 58.

It is to be appreciated that the aforesaid twenty five degree (25°) angle of orientation of the driven rollers 58 is only a preferred embodiment and is not to be understood to be a limitation of the right-angle transfer module 10. Rather it is to be understood that the driven rollers 58 may be oriented at any angle relative to the transport belt 22 that enables a document to change its direction by ninety degrees (90°) relative to the longitudinal axis of the transport belt by abutting against registration wall 54.

As best seen in FIG. 4 (and as seen in phantom lines), providing constant drive to each driven roller 58 is a drive shaft 59 coaxially mounted through each roller 58. Each drive shaft 59 is provided with one or more pulleys 61 and wrapping around each pulley 61 is a drive belt 63. A motor 65 is mounted on the underside of the deck assembly 15 and connects to one of the drive belts 63 so as to provide constant drive to each roller 58.

Referring again to FIG. 6, preferably each idler roller 56 has a spherical configuration and extends partially downward through a circumferential opening formed in a housing 60. Each housing 60 extends downward from an second mounting plate 62, which mounting plate 62 extends from, and is fixably connected to the registration wall 54. Within each housing 60 is provided a spring 64 that is biased between the top surface portion of the spherical roller 56 and the top wall of the second mounting plate 62 so as to provide the normal force against the corresponding lower driven roller 58.

Figure 7:
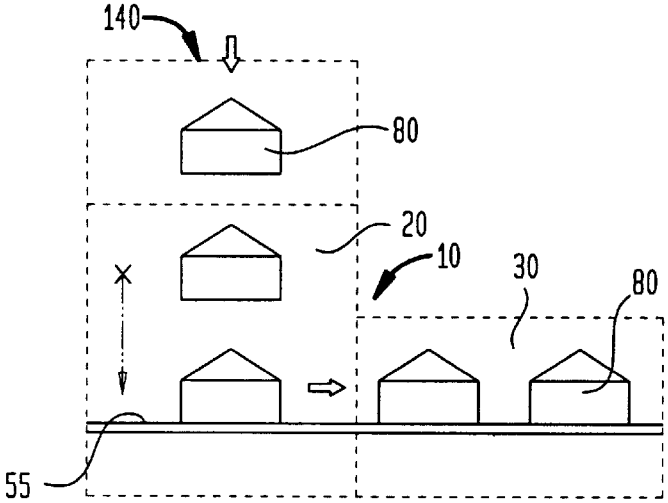
FIG. 7 is a block diagram depicting the envelope travel direction in the right-angle transfer module of FIG. 3.

Referring now to FIGS. 2, 4 and 7, in operation, the transfer module 10 takes a stuffed open envelope 80 conveyed from the envelope insertion station 140 of inserter system 100 and changes it direction of travel by ninety degrees (90°) without turning the envelope (FIG. 7). Preferably, the envelope 80 is then conveyed to a sealing station 150 for the sealing of the open envelope 80. More specifically, the input section 20 of the right-angle transfer module station 10 is mounted adjacent and in-line with the envelope insertion station 140 so as to seize control of the envelope being conveyed from the envelope insertion station 140. As previously mentioned, it is the combination of the transport belt 22 with the idler rollers 34 in the input section 20 that seizes the envelope 80 from the insertion station 140 and conveys the envelope 80 toward its transfer section 30.

Once the envelope is engaged within the nip formed between the aforesaid rollers 56 and 58 in the transfer section 30, the envelopes direction changes twenty five degrees (25°) (relative to the longitudinal axis of the transport belt 22) until the envelope is caused to abut against the registration wall 54 (as caused by the aforesaid resulting horizontal and vertical velocity vectors of the driven rollers 58). Once in abutment with the registration wall 54, the envelope 80 stays in abutment with the registration wall 54 (as caused by the vertical velocity vector of the driven rollers 58) and the envelopes 80 travel direction is changed ninety degrees (90°) (relative to the longitudinal axis of the transport belt 22) and continues in this direction (as caused by the horizontal velocity vector of the driven rollers 58) whereafter the envelope 80 is caused to convey into the sealing station 150 for further processing.

As previously mentioned, the position of the registration wall 54 (via deck plate assembly 15) is adjustable for handling different sized envelopes. FIG. 4 depicts the transfer section 30 in its proximal-most position, while in phantom lines (as indicated by arrow 31) it is depicted in its distal-most position. As seen in FIG. 4, it is the distance between the registration wall 54 and the envelope insertion station 140 that is adjustable. Accordingly, the sealer station 150 preferably also has an adjustable wall that cooperates with the registration wall 54 of the transfer module 10 for accommodating different sized envelopes.

In summary, an a right-angle transfer module 10 for changing the direction of travel of an envelope by ninety degrees (90°) in a high speed mass mailing inserter system 100 has been described. Although the present invention has been described with emphasis on a particular embodiment, it should be understood that the figures are for illustration of the exemplary embodiment of the invention and should not be taken as limitations or thought to be the only means of carrying out the invention. Further, it is contemplated that many changes and modifications may be made to the invention without departing from the scope and spirit of the invention as disclosed.

What is claimed is:

1. An apparatus for changing the direction of travel of a flat article being conveyed seriatim along a paper path without changing the orientation of the flat article with respect to an input direction of travel, comprising:

a deck having an upstream end for receiving a flat article being conveyed along a paper path in an input direction;

a registration wall upstanding on the deck and spaced from the upstream end, the registration wall having a longitudinal axis defining an output direction that is substantially orthogonal to the input direction; and a drive assembly operatively coupled to the deck in proximity to the registration wall and being operative to seize a leading edge of a flat article traveling in the input direction on the deck and change the flat articles travel direction such that the flat article is conveyed in the output direction whereby the leading edge of the flat article abuts against the registration wall, the drive assembly including:

a plurality of roller pairs operative to seize the leading edge of the flat article traveling in the input direction, wherein each roller pair has travel axis of rotation that is disposed at a twenty five degree (25°) angle relative to the input direction of travel such that the output direction velocity vector imparted on a flat article is 0.906 (cosine25°) and the input direction velocity vector imparted on a flat article is 0.422 (sine25°) whereby the vertical velocity vector causes the leading edge of the flat article to register against the registration wall and the horizontal velocity vector conveys the flat article in the output direction along the longitudinal axis of the registration wall while the leading edge remains in registration with the registration wall.

2. The apparatus as recited on claim 1 wherein each roller pair of the drive assembly includes an upper idler roller and a cooperating lower driven roller.

3. The apparatus as recited in claim 2 wherein the upper idler roller has a spherical configuration.

4. The apparatus as recited in claim 1 further including a input drive assembly operatively coupled to the deck in proximity to the upstream end and operative to seize the first leading edge of a flat article conveying on the upstream end of the deck to further convey the flat article in the first direction on the deck.

5. The apparatus as recited in claim 4 wherein the input drive assembly includes a plurality of upper idler rollers cooperating with a lower driven belt.

* * * * *